United States Patent [19]

Lin et al.

[11] Patent Number: 4,932,800

[45] Date of Patent: Jun. 12, 1990

[54] FINGER GRIPPING DEVICE

[75] Inventors: Nan J. Lin, Burlington; Richard J. Petrillo, Norwell; John Thompson, Medfield, all of Mass.

[73] Assignee: The Gillette Company, Boston, Mass.

[21] Appl. No.: 348,358

[22] Filed: May 8, 1989

[51] Int. Cl.[5] ..... B43K 23/00

[52] U.S. Cl. ..... 401/6; 401/88

[58] Field of Search ..... 401/6, 88, 91, 8; 24/530; D19/35, 41, 45, 48

[56] References Cited

U.S. PATENT DOCUMENTS

| | | | |
|---|---|---|---|
| 1,291,972 | 1/1919 | McGuigan | 120/84 |
| 1,598,873 | 9/1926 | Peterson | 401/6 |
| 1,807,415 | 5/1931 | LaFrance | 120/42 |
| 2,173,451 | 9/1939 | Lorber | 120/103 |
| 2,180,560 | 11/1939 | Stempel | 120/9 |
| 2,236,194 | 3/1941 | Lorber | 120/103 |
| 2,594,955 | 4/1952 | Markowitz | 401/88 X |
| 2,759,453 | 8/1956 | De Baun | 120/9 |
| 3,269,399 | 8/1966 | Smith | 135/51 |
| 4,035,089 | 7/1977 | Schwartz | 401/6 |
| 4,167,347 | 9/1979 | Heyle | 401/88 |
| 4,601,598 | 7/1986 | Schwartz | 401/6 |

FOREIGN PATENT DOCUMENTS

| | | | |
|---|---|---|---|
| 546632 | 3/1932 | Fed. Rep. of Germany | 401/6 |
| 2157175 | 5/1973 | Fed. Rep. of Germany | 401/6 |
| 88/00002 | 1/1988 | PCT Int'l Appl. . | |
| 3922 | 4/1903 | United Kingdom | 401/6 |

*Primary Examiner*—Richard J. Johnson

*Attorney, Agent, or Firm*—John P. Morley

[57] ABSTRACT

A compressible finger gripping device for assembly with the surface portion of an article such as a writing instrument or a shaving instrument or the like. The device includes a substantially cylindrical body formed of a compressible, elastomeric material and defined by a substantially uniform OD and ID along the axial length of the body. A plurality of ribs arranged substantially parallel to the longitudinal axis of the body and substantially equidistantly spaced apart from each other are carried about the I.D. The combination of the selected compressible material, the selected I.D. and OD dimensions of the body and the selected number, depth and thickness of the ribs cooperate and converge to provide a compressibility index (CI) valve for the device between about 1000 to about 18,000 gms/cm.

14 Claims, 2 Drawing Sheets

FINGER GRIPPING DEVICE

BACKGROUND OF THE INVENTION

Part 1. The Field of the Invention

This invention relates to an improved finger gripping device which provides improved comfort during manipulation and use of an article employing the device.

Part 2. Description of the Prior Art

Devices designed to provide a comfortable finger gripping area for finger manipulated articles—such as writing instruments—are known to the art. Examples of such devices are disclosed in U.S. Pat. Nos. 4,601,598; 4,167,347; 4,035,089; 2,236,194; 2,180,560; 2,173,451; and 1,807,415. Foreign Patents disclosing such devices include German Patent Nos. 1,511,325; 2,157,175; and International patent application No. PCT/US88/00002. Essentially, known finger gripping devices provide a sleeve of resilient compressible material extending about the finger gripping area of the device or involve the integration of a compressible material with at least a portion of the device's gripping area. The basic function assigned the compressible material is to deform on application of gripping pressure and to at least partially assume the shape of the gripping fingers during manipulation of the article by the user. Usually, the compressible material is sufficiently resilient to recover its original shape shortly after removal of gripping pressure by the user.

Although finger gripping devices are known and have enjoyed a degree of acceptance, there remains an outstanding need for further improved finger gripping devices especially in terms of a significantly improved degree of comfort which is suitable and acceptable to a significant majority of users of such devices. There is also an outstanding need for the development of some value or standard which represents a reliable measure of those critical performance characteristics of finger gripping devices which a significant majority of users would rate as favorable and acceptable. The present invention is directed to those needs and provides an especially relevant response to them together with other advantages and benefits.

SUMMARY OF THE INVENTION

The present invention presents to the art a novel, improved finger gripping device adapted for assembly with a surface portion of an article used by finger manipulation such as a writing or shaving instrument, or the like. Finger gripping devices of the present invention comprise a substantially cylindrical body formed by a resilient, compressible, elastomeric material and have an outer surface defined by an OD and an inner surface (ID) defined by an ID. A plurality of ribs are carried about the inner surface (ID) and arranged substantially parallel to the longitudinal axis of the body and substantially equidistantly spaced apart from each other. The combination of the selected compressible material, the selected dimensions of the body OD and ID and the selected number and depth and thickness of the ribs cooperate and converge to provide a compressibility index (CI) value for the device between about 1000 to about 18,000 gm/cm.

For the purposes of this invention, the compressibility index (CI) is defined as the slope of the force/compression distance curve at a distance of compression of 0.025 cm. as measured in accordance with the procedure described later. The CI value has been derived from extensive consumer test data involving test subject responses to numerous commercial and experimental finger gripping devices. The consumer test data was analyzed and evaluated to determine if some common factor or factors existed which could be used to reliably predict test subject's favorable ratings and acceptance for a given finger gripping device. Interpretation of the data indicated that favorable test subject response to a given device apPeared to be primarily dependent on the combination of the softness and compressibility and resiliency properties provided by the tested device. These properties, in turn, are dependent on the combination of the compressible material and configuration selected to provide the device. In accordance with our invention, we have found that a close correlation exists between CI value and the test subjects' perception of increased comfort and decreased fatigue in use of the device. For example, we have found that devices having a CI value between about 1000 to about 18,000 gm/cm. have been consistently given favorable and acceptable ratings by a significant majority of test subjects while devices having CI values outside the range do not receive such ratings. Accordingly, the CI value is an important standard for reliably predicting the degree of consumer acceptance for a given finger gripping device and provides a valuable tool for developing finger gripping devices having a high potential for commercial success.

BRIEF DESCRIPTIONS OF THE DRAWINGS

Features of finger gripping devices of the present invention will be more fully appreciated by reference to the following drawings, in which.

DESCRIPTION OF THE INVENTION

Figure 2:
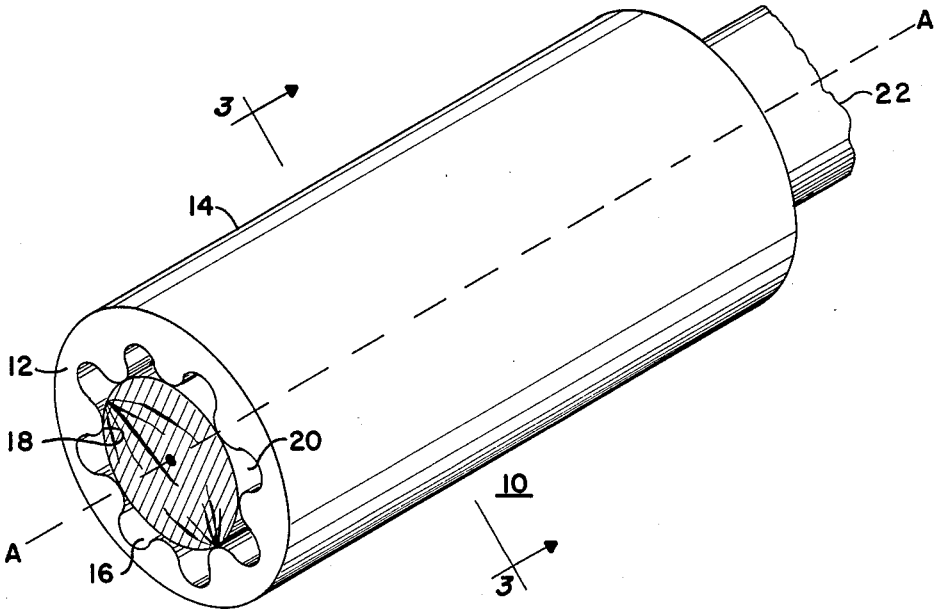
FIG. 2 is a cross-sectional view of the finger gripping device of FIG. 1 shown assembled on the surface of a writing instrument.

Referring first to FIG. 2, a representative finger gripping device 10 includes a cylindrical body 12 providing an outer surface 14 having an OD which may be substantially uniform or slightly tapered along the axial length and an inner surface 16 preferably having a substantially uniform ID along the axial length. Body 10 comprises a resilient, compressible, elastomeric material and preferably a compressible thermoplastic elastomeric material which is moldable. Especially preferred thermoplastic elastomeric materials are block copolymers comprising styrene, ethylene, and butylene. Representative useful thermoplastic elastomers include commercially available polyolefin thermoplastic elastomeric polymers such as those sold under the tradenames "SOMEL" by E. I. DuPont de Nemours & Co. or "TELCAR" by B. F. Goodrich Co. or "PROFAX" by Hercules Inc. Block copolymers such as styrene-butadiene-styrene copolymers sold under the tradename KRATON D by Shell Chemical Co. or styrene-ethylene/butylene-styrene copolymers sold under the tradename KRATON G by Shell Chemical Co. are especially preferred. Other representative suitable thermoplastic elastomers include polyester and polyurethane thermoplastic elastomers.

Figure 3:
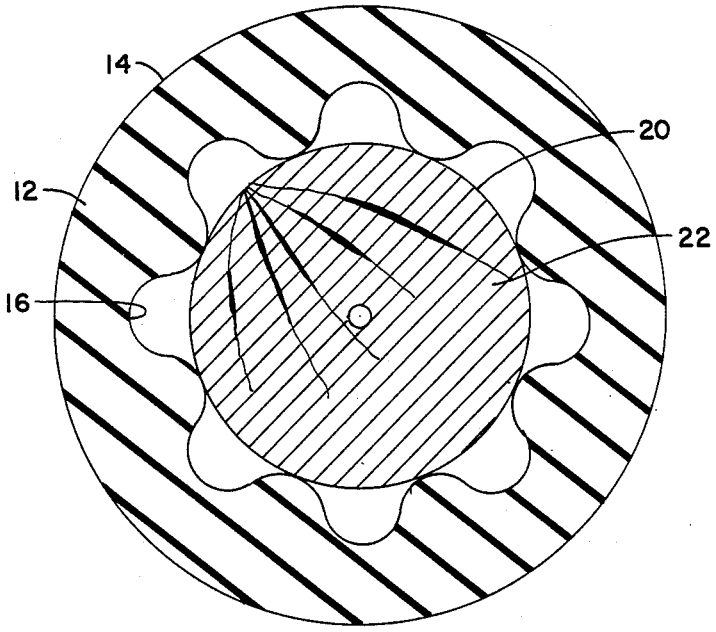
FIG. 3 is a sectional view of the finger gripping device of FIG. 2 taken along lines 3—3.

The axial length of body 12 must be sufficient to provide a suitable finger gripping area, which in the case of a writing instrument is usually about five centimeters. Outer surface 14 of body 10 may include a pattern formed during or after molding to facilitate gripping of surface 10 with the finger. Inner surface 16 carries a plurality of ribs 18 arranged substantially parallel to longitudinal axis A-A of body 12. Preferably, ribs 18 are substantially equidistantly spaced apart from each other, and the number of ribs can vary between three to about usually no more than about twelve. As shown in FIGS. 2 and 3, a preferred number of ribs 18 is eight and preferably the eight ribs 18 are arranged about inner surface 16 in an undulating fashion. Ribs 18 are adapted for close communication with outer surface 20 of writing instrument 22 as shown in FIGS. 2 and 3 so that a friction fit is obtained between ribs 18 and outer surface 20.

Figure 1:
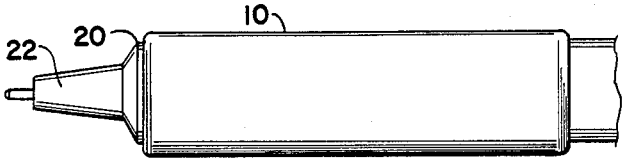
FIG. 1 is a perspective view showing a form of a finger gripping device of the present invention.

Finger gripping device 10 of the type shown in FIGS. 1–3 is adapted for assembly with surface 20 of writing instrument 22. Usually, assembly is achieved by simply sliding device 10 onto the portion of surface 20 where the fingers normally engage writing instrument 22. Alternatively, device 10 can be permanently bonded or otherwise permanently affixed to surface 20 of writing instrument 22 if desired. Moreover, device 10 can be assembled with writing instruments so that outer surface 14 of device 10 extends above, along, or below the outer dimensions of finger gripping surface 20.

Figure 4:
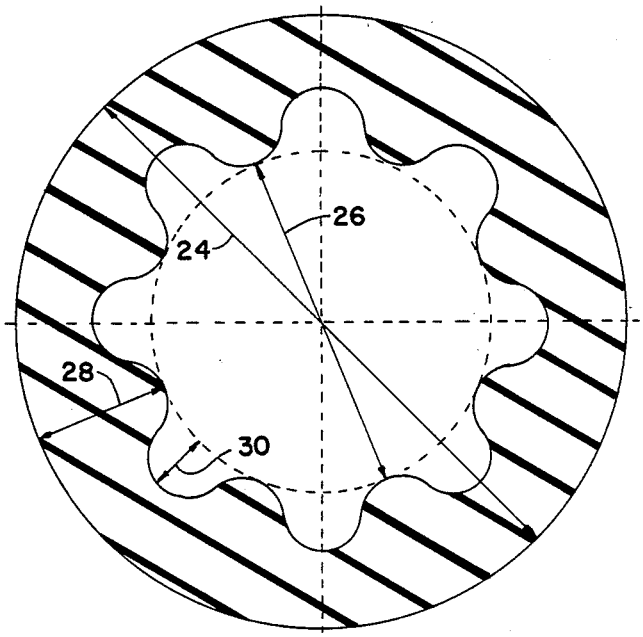
FIG. 4 is a cross-sectional view similar to the view shown in FIG. 3 and illustrating dimensional ranges of finger gripping devices of the invention.

FIG. 4 illustrates preferred ranges of dimensions involved in device 10. As shown there, OD 24 is between about 0.6 cm to about 3.0 cm while ID 26 is between about 0.3 cm to about 2.5 cm. The depth of rib 18 is shown as 30, and the thickness is shown as 28. The ratio of depth 30 to thickness 28 is in a range between about 1:16 to about 3:4.

The distinctive feature of finger gripping devices 10 of the present invention is that the selected compressible material for device 10 in combination with the selected OD and ID dimensions and the selected ratio of depth to thickness of ribs 18 cooperatively converge to provide a finger gripping device having a compressibility index (CI) value between about 1000 to about 18,000 gm/cm. The preferred finger gripping devices of the present invention have CI values between about 3600 to about 16,000 gm/cm. In accordance with the present invention, the CI value of a finger gripping device is measured on an Instron Model 1122 compression tester while the finger gripping device is assembled on a portion of the finger gripping surface of an instrument as shown in FIGS. 2 and 3. The procedure involves fixedly positioning the device in alignment with a probe which consists of a cylindrical aluminum rod having a radius of 0.8 cm and the end of the rod which contacts the device during measurement has a curvature with a tip radius of 0.6 cm and a chamfer radius of 0.2 cm. The probe is arranged for reciprocal movement through a vertical distance after the bottom surface of the probe is brought into contact with the outer surface of the device. The probe is then moved downward on the outer surface of the device at a controlled rate of travel of 0.13 cm/min, and the force of compression generated by the probe vs the distance of compression is continually monitored and transmitted to a recorder for recording on an X-Y graph. As mentioned, the CI value corresponds to the slope of the force/compression distance curve at a distance of compression of 0.025 cm.

Details of the invention will be more fully appreciated by the following non-limiting, illustrative Examples.

EXAMPLE 1

A molding composition was prepared by mixing 96 percent by weight of a styrene-ethylene/butylene-styrene elastomer (KRATON G 2706) and 4 percent by weight of carbon black pigment and injection molding the composition at 380° F. to provide a finger gripping device having a configuration substantially as shown in FIGS. 1–3. The length of the device was 3 cm; the OD was 1.0 cm along the length of the device while the ID was 0.5 cm. The eight ribs carried about the ID were substantially equidistantly spaced apart from each other, and the ratio of rib depth to rib thickness was 1:2.3. The CI value of the finger gripping device was 4100 gm/cm.

EXAMPLE 2

This Example presents the results of a consumer test involving a comparison between the device of Example 1 assembled on a pen and a commercially available finger gripping device known in the art under the tradename Waterman International Ballpoint Grip (WIBG) assembled on the same type of pen. The WIBG has a tubular body of a resilient, compressible elastomer and is 3 cm in length and has an OD and ID of respectively 1.0 cm and 0.5 cm along the length of the device. The CI value of the WIBG was 26,000 gm/cm.

Table 1 below summarizes the overall rating results of the device of Example 1 and the WIBG in a test involving office workers and student subgroups.

TABLE 1

| | TOTAL SAMPLE | | OFFICE WORKERS | | STUDENTS | |
|---|---|---|---|---|---|---|
| DEVICE | WIBG | EXAMPLE 1 | WIBG | EXAMPLE 1 | WIBG | EXAMPLE 1 |
| 10-Excellent | 14 | 22 | 10 | 21 | 17 | 24 |
| 8–10 | 32 | 52 | 28 | 42 | 35 | 62 |
| 4–7 | 46 | 31 | 50 | 39 | 42 | 23 |
| 1–3 | 22 | 17 | 22 | 19 | 23 | 15 |
| | 100 | 100 | 100 | 100 | 100 | 100 |
| MEAN | 5.6 | 6.9 | 5.6 | 6.6 | 5.8 | 7.2 |
| SAMPLE SIZE | (156) | (156) | (78) | (78) | (78) | (78) |

TABLE 2

| | TOTAL SAMPLE | | OFFICE WORKERS | | STUDENTS | |
|---|---|---|---|---|---|---|
| DEVICE | WIBG | EXAMPLE 1 | WIBG | EXAMPLE 1 | WIBG | EXAMPLE 1 |
| 10-Very Comfortable | 15 | 26 | 14 | 22 | 15 | 31 |

TABLE 2-continued

| DEVICE | TOTAL SAMPLE WIBG | TOTAL SAMPLE EXAMPLE 1 | OFFICE WORKERS WIBG | OFFICE WORKERS EXAMPLE 1 | STUDENTS WIBG | STUDENTS EXAMPLE 1 |
|---|---|---|---|---|---|---|
| 8–10 | 30 | 53 | 30 | 45 | 30 | 60 |
| 4–7 | 40 | 31 | 38 | 37 | 42 | 26 |
| 1–3 | 30 | 16 | 32 | 18 | 28 | 14 |
| | 100 | 100 | 100 | 100 | 100 | 100 |
| MEAN | 5.5 | 6.9 | 5.3 | 6.5 | 5.7 | 7.4 |

EXAMPLE 3

A molding composition was prepared by mixing 96 percent by weight a styrene-ethylene/butylene styrene block copolymer (KRATON G 7705) and 4 percent by weight carbon black pigment and injection molding the composition at 380° F. to provide a finger gripping device having a configuration substantially as shown in FIGS. 1–3. The length, the OD, the ID, the number, and arrangement of ribs and the ratio of depth to thickness of ribs were the same as in Example 1. However, the CI value of the device was 6,700 gm/cm. In a test involving 46 test subjects, the device of Example 3 was given overall favorable ratings which were 7 percent higher than the ratings given the device of Example 1 and 13 percent higher than the ratings given the WIBG device of Example 2.

From the foregoing description it is apparent that the novel, improved finger gripping devices present many advantages and have a combination of especially attractive performance characteristics. The novel, improved devices are inexpensive, simple to manufacture, easily assembled, and at the same time provide overall performance and comfort ratings which are significantly improved over commercial, finger gripping devices known to the art at the time the invention was made.

What is claimed is:

1. A compressible finger gripping device for assembly with a surface portion of an article used for finger manipulation of the article, said device comprising a substantially cylindrical body having a longitudinal axis and formed of a compressible, elastomeric material, said body being defined by a substantially uniform OD and ID along the axial length, a plurality of ribs of substantially uniform depth carried along the ID and arranged substantially parallel to the longitudinal axis and substantially equidistantly spaced apart from each other, the ratio of rib depth to rib thickness being between about 1:16 to about 3:4, said device having a CI value between about 1000 to about 18,000 gm/cm.

2. A device of claim 1 where said OD is between about 0.6 cm to about 3.0 cm, said ID is between about 0.3 cm to about 2.5 cm, and said ribs are spaced apart from each other by a distance substantially equivalent to between about one-third to about one-twelfth of the ID.

3. A device of claim 2 where the device has a CI value between about 3600 to about 16,000 gm/cm.

4. A device of claim 3 where the ribs are spaced apart from each other by a distance substantially equivalent to between about one-fifth to about one-ninth of the ID.

5. A device of claim 4 where the compressible material is a thermoplastic elastomer.

6. A device of claim 5 where the compressible material is a block copolymer.

7. A device of claim 6 where the ribs are spaced apart from each other by a distance substantially equivalent to about one-eighth of the ID.

8. A writing instrument including a compressible finger gripping device arranged on a surface portion of the instrument normally used for gripping by fingers of the user for manipulation of the instrument, said device comprising a substantially cylindrical body having a longitudinal axis and formed of a compressible, elastomeric material, said body being defined by a substantially uniform OD and ID along the axial length, a plurality of ribs carried about the ID and arranged substantially parallel to the longitudinal axis and substantially equidistantly spaced apart from each other, the ratio of rib depth to rib thickness being between about 1:16 to about 3:4, said device having a CI value between about 1000 to about 18,000 gm/cm.

9. A writing instrument of claim 8 where said OD of the device is between about 0.6 cm to about 3.0 cm, said ID is between about 0.3 cm to about 2.5 cm, said ribs are spaced apart from each other by a distance substantially equivalent to between about one-third to about one-twelfth of the ID.

10. A writing instrument of claim 9 where the device has a CI value between about 3600 to about 16,000 gm/cm.

11. A writing instrument of claim 10 where the ribs of the device are spaced apart from each other by a distance substantially equivalent to between about one-fifth to about one-ninth of the ID.

12. A writing instrument of claim 11 where the compressible material of the device is a thermoplastic elastomer.

13. A writing instrument of claim 12 where the compressible material is a block copolymer.

14. A writing instrument of claim 13 where the ribs of the device are spaced apart from each other by a distance substantially equivalent to about one-eighth of the ID.

* * * * *